US007068161B2

(12) United States Patent
Germaine et al.

(10) Patent No.: US 7,068,161 B2
(45) Date of Patent: Jun. 27, 2006

(54) METHOD AND SYSTEM FOR ANALYZING THE SECURITY OF A FACILITY

(75) Inventors: Robert Alan Germaine, Corvallis, OR (US); Christopher Steven Goz, Parker, CO (US)

(73) Assignee: CH2M Hill, Inc., Englewood, CO (US)

( * ) Notice: Subject to any disclaimer, the term of this patent is extended or adjusted under 35 U.S.C. 154(b) by 0 days.

(21) Appl. No.: 10/632,239

(22) Filed: Jul. 31, 2003

(65) Prior Publication Data

US 2005/0024204 A1 Feb. 3, 2005

(51) Int. Cl.
*G08B 29/00* (2006.01)

(52) U.S. Cl. ..... 340/506; 340/540; 703/1; 702/81; 702/155; 702/182; 52/741.3; 52/750

(58) Field of Classification Search ..... 340/506, 340/511, 517, 525, 531; 705/7, 13; 703/1; 345/781, 764; 702/19, 22, 33; 700/83
See application file for complete search history.

(56) References Cited

U.S. PATENT DOCUMENTS 4,964,060 A * 10/1990 Hartsog ..... 703/1
5,295,062 A * 3/1994 Fukushima ..... 700/83
5,297,252 A * 3/1994 Becker ..... 345/803
5,440,498 A * 8/1995 Timm ..... 340/541
5,650,800 A * 7/1997 Benson ..... 345/173
5,726,884 A * 3/1998 Sturgeon et al. ..... 705/9
5,815,417 A 9/1998 Orr et al.
5,977,872 A * 11/1999 Guertin ..... 340/515
6,003,010 A * 12/1999 Scolly et al. ..... 705/8
6,243,483 B1 6/2001 Petrou et al.
6,293,861 B1 * 9/2001 Berry ..... 454/255
6,408,307 B1 6/2002 Semple et al.
6,415,291 B1 7/2002 Bouve et al.
6,574,561 B1 6/2003 Alexander et al.
6,610,977 B1 * 8/2003 Megerle ..... 250/287
6,651,011 B1 * 11/2003 Bache ..... 702/33
6,701,281 B1 * 3/2004 Satoh et al. ..... 702/182
2001/0027388 A1 10/2001 Beverina et al.
2001/0027389 A1 10/2001 Beverina et al.
2002/0016757 A1 2/2002 Johnson et al.
2003/0004693 A1 1/2003 Neiman et al.
2003/0127122 A1 * 7/2003 Gower ..... 135/87
2003/0210139 A1 * 11/2003 Brooks et al. ..... 340/531
2004/0117624 A1 * 6/2004 Brandt et al. ..... 713/166

* cited by examiner

*Primary Examiner*—Benjamin C. Lee
(74) *Attorney, Agent, or Firm*—Perkins Coie, LLP

(57) ABSTRACT

A method and system for analyzing the security of a facility. The security system evaluates whether the elements of a facility comply with security requirements and provides a graphical representation of the facility with the results of the evaluation displayed. The security system provides a user interface through which security personnel can provide information describing the characteristics of each element of a facility. The security system then applies a rule for each security requirement to determine whether each element complies with the security requirement. The security system then displays a map of the facility with elements highlighted to indicate whether they comply with the security requirements.

21 Claims, 14 Drawing Sheets

1001

1002

1003

METHOD AND SYSTEM FOR ANALYZING THE SECURITY OF A FACILITY

STATEMENT REGARDING FEDERALLY SPONSORED RESEARCH

The United States Government has rights in this invention pursuant to Architect-Engineer Contract No. F41624-00-D-8021, dated 17 Feb. 2000, and Delivery Order/Call No. 0125, dated 14 Sep. 2001, between the Department of the Air Force/AFMC and CH2M Hill, Inc.

TECHNICAL FIELD

The described technology relates generally to analyzing security of a facility to withstand a terrorist attack.

BACKGROUND

The security of facilities such as military installations, nonmilitary government installations, corporate campuses, and nuclear power plants has been a concern for quite some time. As terrorist attacks increase, the security of these facilities also need to increase. From time to time various organizations, such as a nuclear regulatory agency or a branch of the military, may promulgate directives or guidelines relating to the security of facilities. For example, a branch of the military may promulgate a directive that no building within a military base should be within 100 feet of the perimeter of the base unless the perimeter fencing meets a certain requirement (e.g., includes razor wire). As another example, a corporation may promulgate a rule that access to each door of its buildings is to be secured and that each window exposed to the outside of the corporate campus must be permanently closed.

An organization may promulgate directives listing many requirements that should be complied with to address various security threats. If a facility has many buildings, it may be a difficult and time-consuming task to ascertain whether each building complies with the requirements. For example, a single building may have more than 100 windows that each must be analyzed to determine whether it complies with the appropriate security requirements. In addition, as an organization promulgates new directives and modifies existing directives, the process of ascertaining whether each building complies with the requirements of the new directives and modified directives needs to be performed.

When a facility has many buildings, it can be difficult for a person responsible for the security of the facility (e.g., security personnel) to know which buildings currently comply with the requirements, which buildings do not, and which buildings have not even been evaluated for compliance. In addition, since some requirements may be more important than others, security personnel may want to track which requirements are complied with by each building so that efforts to comply with the security requirements can be prioritized.

It would be desirable to have a computer system that would assist security personnel to identify what security requirements are met for each building of a facility.

DETAILED DESCRIPTION

Figure 1:
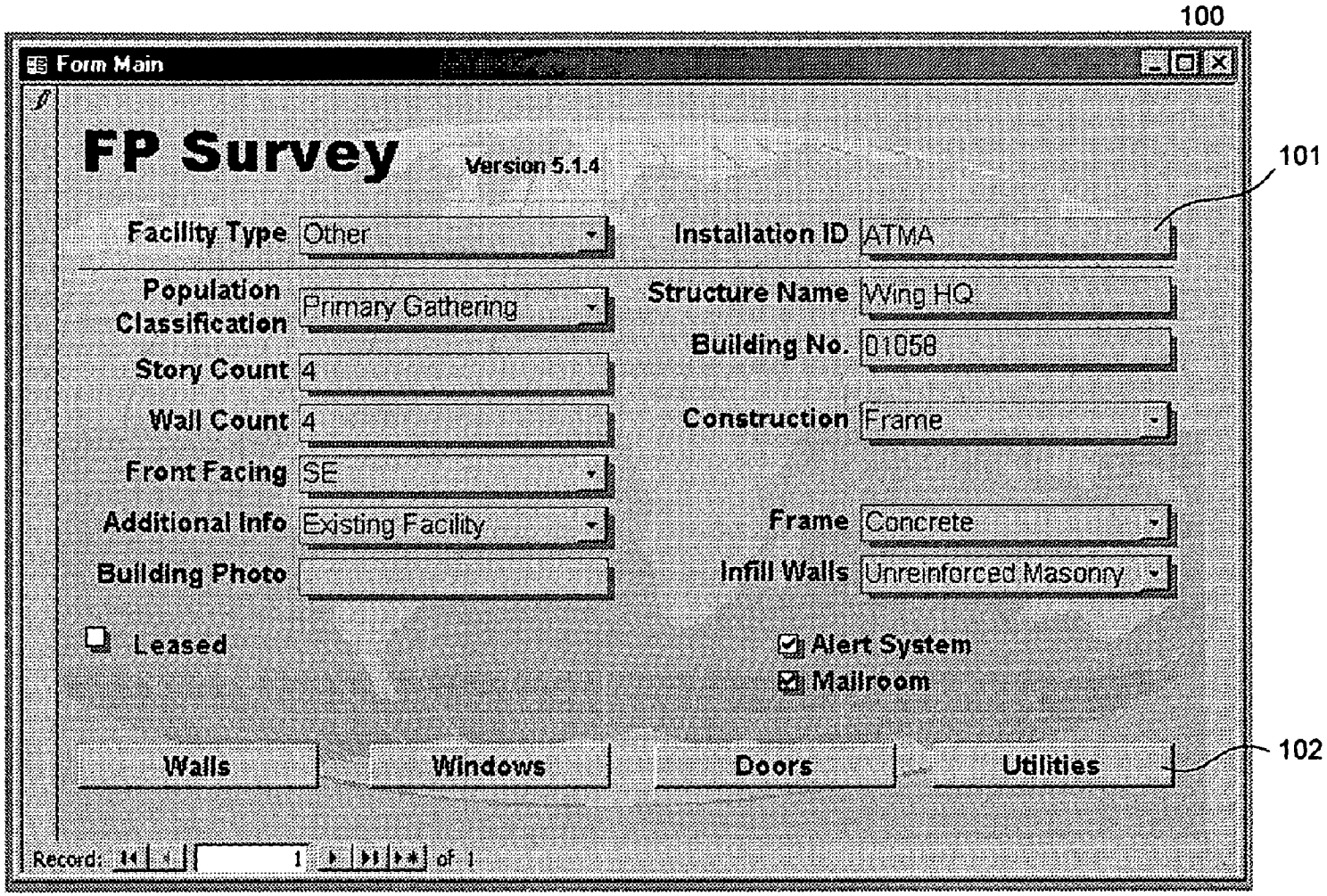
FIG. 1 is a display page for input of information describing the overall characteristics of a building in one embodiment.

A method and system for analyzing the security of a facility is provided. In one embodiment, the security system evaluates whether the elements of a facility comply with security requirements and provides a graphical representation of the facility with the results of the evaluation displayed. For example, the facility may be a military base and the elements may be buildings or open areas (e.g., a baseball field) within the base. One security requirement may specify the minimum thickness of a window, and another may specify the minimum distance between each building and the facility perimeter. The security system provides a user interface through which security personnel can provide information describing the characteristics of each element of a facility. The characteristics may include the thickness of a window of a building and the distance from the building to the facility perimeter. The security system stores the provided information in a database. The security system then applies a rule for each security requirement (e.g., distance to perimeter should be more than 100 feet) to determine whether each element complies with the security requirement. The security system then displays a map of the facility with elements highlighted to indicate whether they comply with the security requirements. For example, each element that fails to comply with at least one security requirement may be highlighted in red, and each element that complies with all the security requirements may be displayed in green. The security system may also allow a user to select a security requirement or subset of security requirements whose compliance is indicated by highlighting. For example, if a user selects a security requirement relating to window thickness, then the security system may highlight only those elements that do not comply with the window thickness security requirement. In this way, security personnel can easily visualize and identify which elements satisfy which security requirements.

In one embodiment, the security system uses a geographic information system ("GIS") to control the displaying of the map of the facility. The GIS may have a database that describes the location of buildings, roads, parking areas, fencing, use areas, and so on of a facility. The security system invokes the GIS to display a map and provides an indication of the highlighting that is to be used for each building or, more generally, each element. The GIS displays the map with the indicated highlighting and allows a user to zoom in and out and scroll around the map. When a user selects a displayed element (e.g., a building), the security system displays detailed information about the element. For example, the security system may display a dialog box that lists each security requirement and indicates whether the selected building complies with each security requirement. The security system may also allow the user to select the types of elements to be displayed. For example, the user may request to view the buildings and fences of the facility, but not the roads and parking areas.

In one embodiment, the security system allows a user to input certain information about a characteristic of a building (or more generally an element) that was not initially provided. For example, the user may know that the building has been reinforced and thus is now blast resistant. After the user indicates that the building is blast resistant, the security system may reevaluate whether any of the security requirements have been met. The security system may also allow the user to input mitigation information about a security requirement for a building. For example, a security requirement may specify the minimum distance between a building and the facility perimeter. That requirement, however, may be mitigated by placing a jersey barrier between the perimeter and the building. In such a case, the security system allows the user to indicate the measures taken to mitigate the security risks. When the security system subsequently displays that building, it may use a different highlighting to indicate that, although the security requirement has not been complied with, the risk has been mitigated.

In one embodiment, the security system may allow the user to relax certain security requirements to help a user evaluate the cost/benefit tradeoffs of strictly complying with a security requirement. For example, a facility may have 10 buildings that do not comply with a 100-foot minimum distance to perimeter security requirement. One solution might be to move the entire perimeter. If the minimum distance is relaxed to 90 feet, however, it may be that only one building does not comply with the relaxed requirement. If so, the security personnel may decide that the additional security benefit of moving the perimeter is not worth the cost. The security system may display the nine buildings with highlighting to indicate that, although they do not comply with the security requirement, they do comply with the relaxed security requirement. The security personnel may decide to perform mitigation for the tenth building and perform no or minimal mitigation for the nine other buildings.

FIGS. 1–5 are display pages for input of information describing the characteristics of the buildings of a facility in one embodiment. FIG. 1 is a display page for input of information describing the overall characteristics of a building in one embodiment. The display page 100 includes various input fields 101 for input of information and various buttons 102 to access additional display pages for input of more detailed information. In this example, the display page includes fields for input of population classification, story count, wall count, structure name, building number, construction, and so on. One skilled in the art will appreciate that the field names are descriptive of the information that is collected. For example, the construction field may be used to specify the construction type of frame, masonry, cement, and so on. The possible options of such a field may be provided in a drop-down list. The building photo field allows the user to identify a file that contains a photograph of the building. The security system may provide an option that would allow a user to view the photograph of a selected building. The button allows the user to access display pages for providing information on walls, windows, doors, and utilities of the building.

Figure 2:
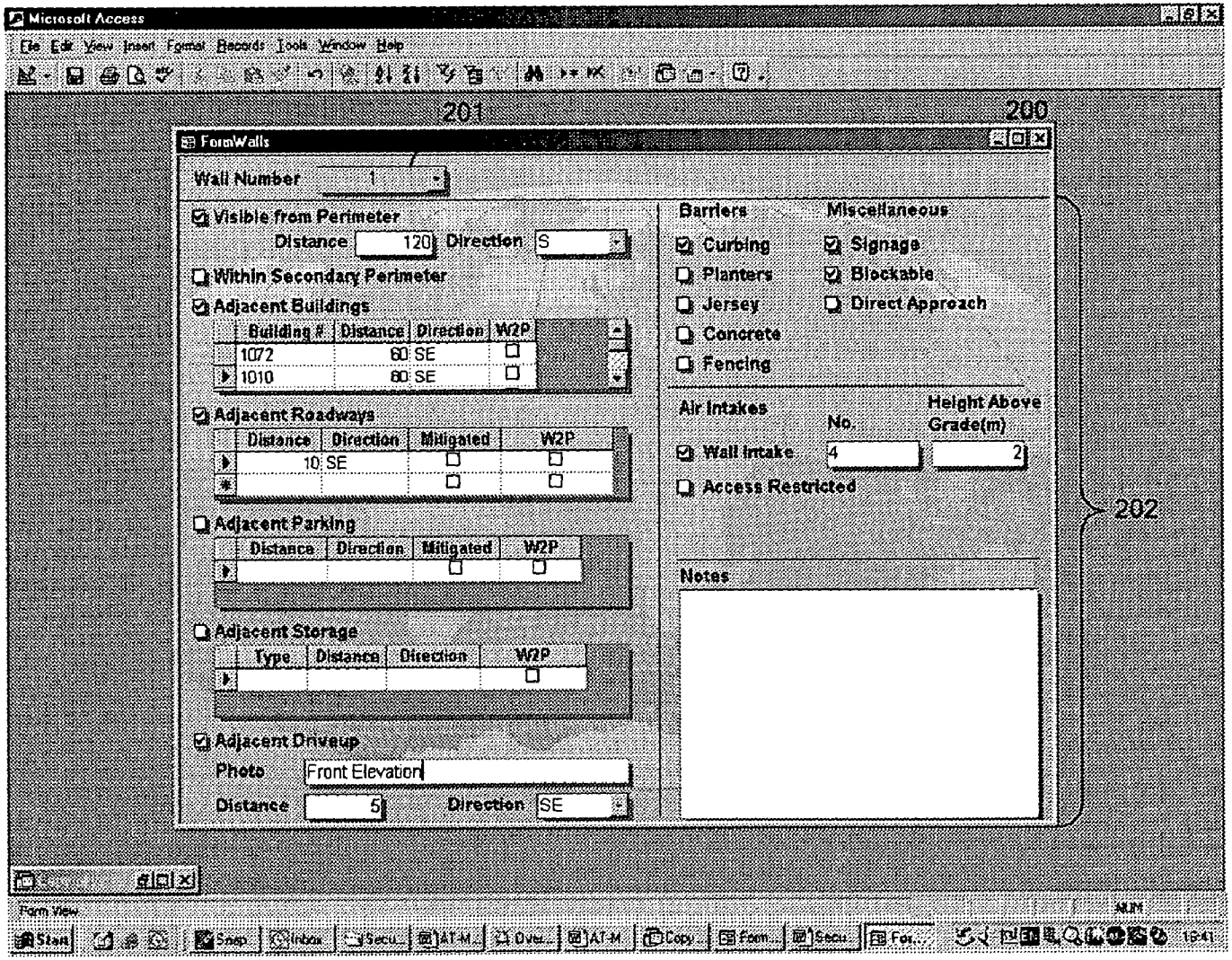
FIG. 2 is a display page for input of information describing the walls of a building in one embodiment.

FIG. 2 is a display page for input of information describing the walls of a building in one embodiment. The display page 200 includes a wall number field 201 and input fields 202. The wall number field identifies the wall number for which the data of the input fields apply. The field names of the input fields are descriptive of the information to be input in the field. For example, the field "distance" under the heading "visible from perimeter" is for entry of the distance of the wall to the perimeter of the facility. The "adjacent buildings," "adjacent roadways," "adjacent parking," and "adjacent storage" headings identify areas for entry of adjacent building, roadway, parking, and storage information.

Figure 3:
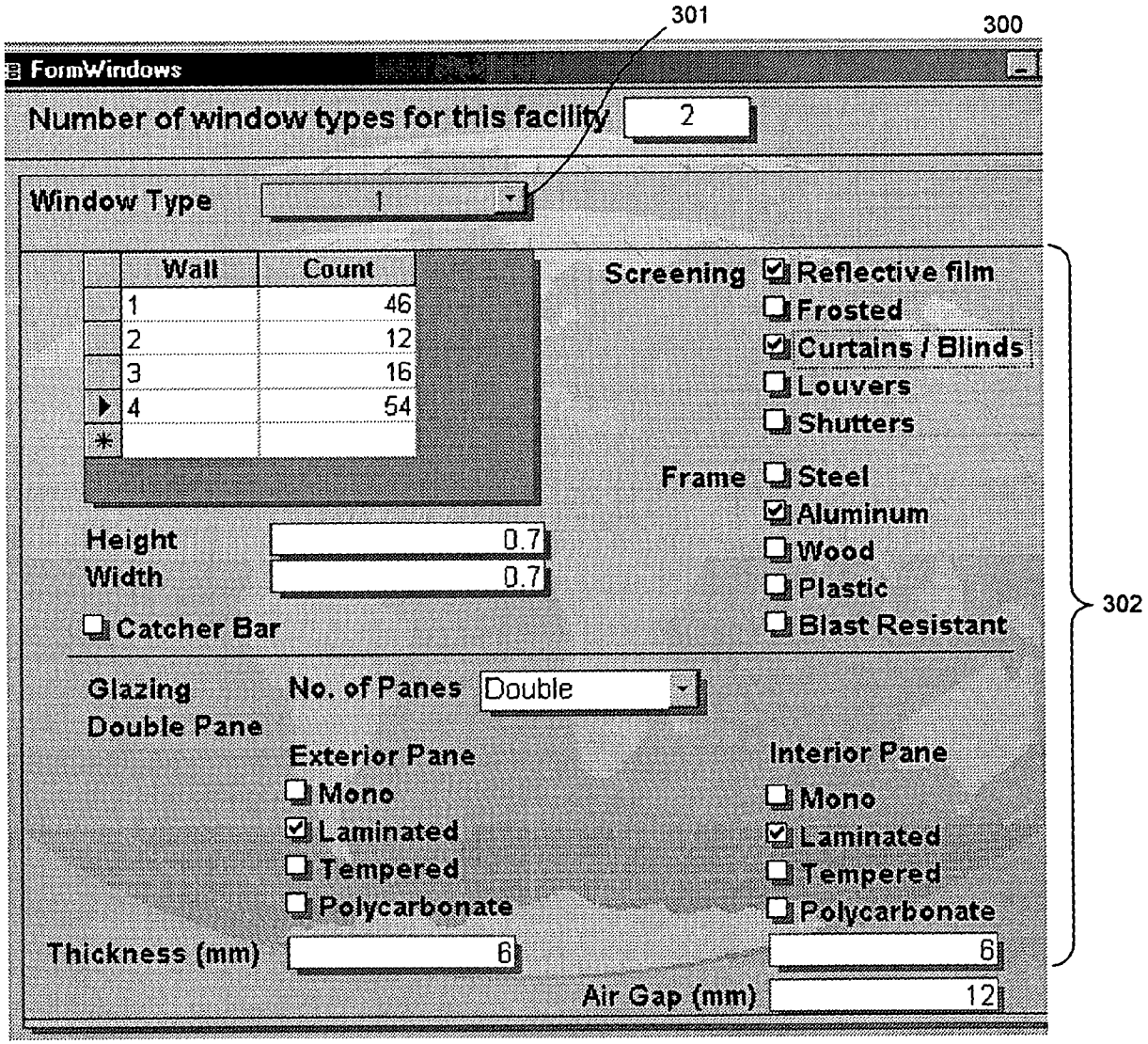
FIG. 3 is a display page for input of information describing the windows of a building in one embodiment.

FIG. 3 is a display page for input of information describing the windows of a building in one embodiment. The display page 300 includes a window type field 301 and entry fields 302. The windows are grouped by shared characteristics (e.g., number of panes and thickness) referred to as a window type. The headings are descriptive of the data collected by each of the fields. The wall and count headings identify fields for entry of the number of windows of the specified window type on each wall.

Figure 4:
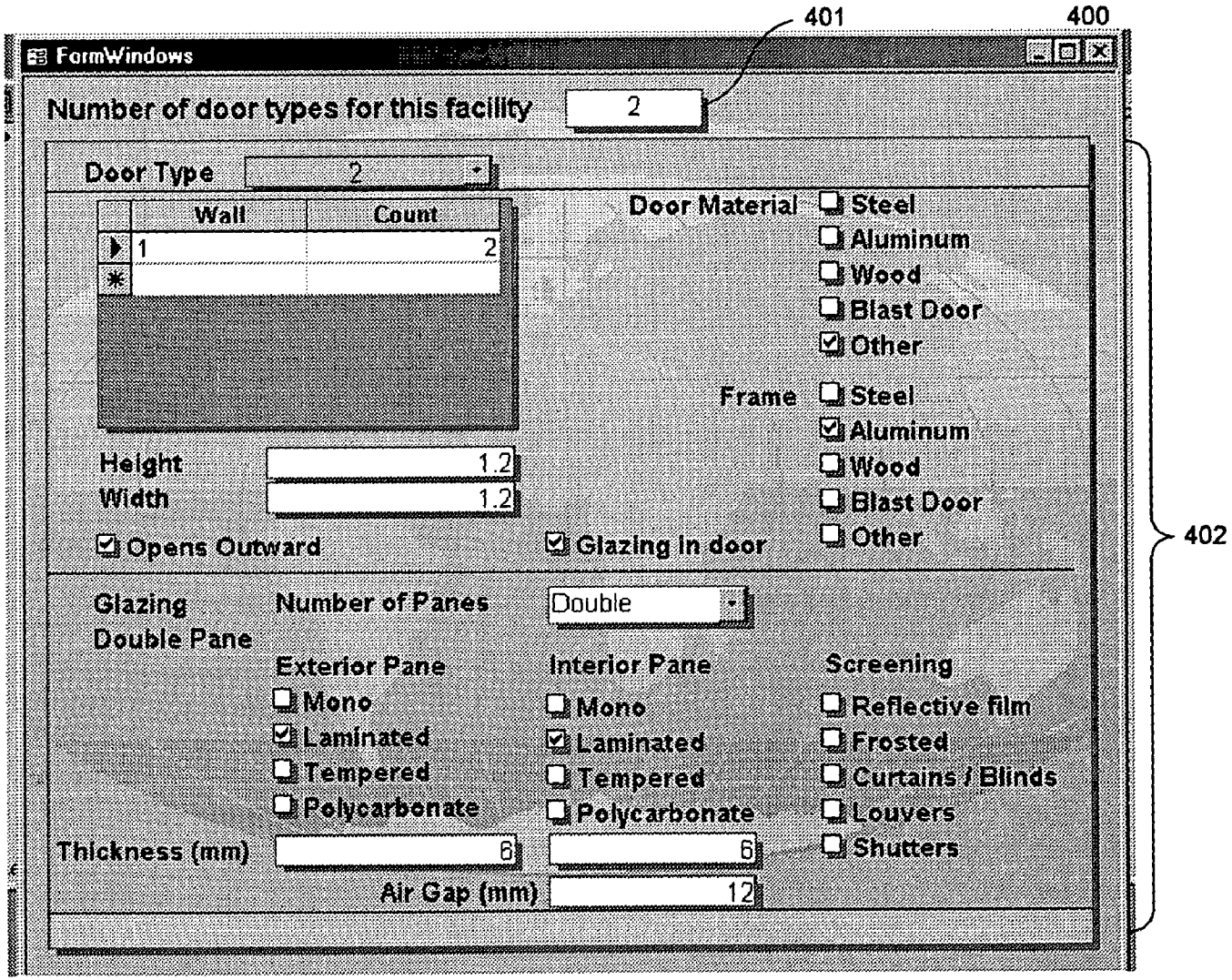
FIG. 4 is a display page for input of information describing the doors of a building in one embodiment.

FIG. 4 is a display page for input of information describing the doors of a building in one embodiment. The display page 400 includes a door type field 401 and entry fields 402. The door type field is analogous to the window type field of FIG. 3.

Figure 5:
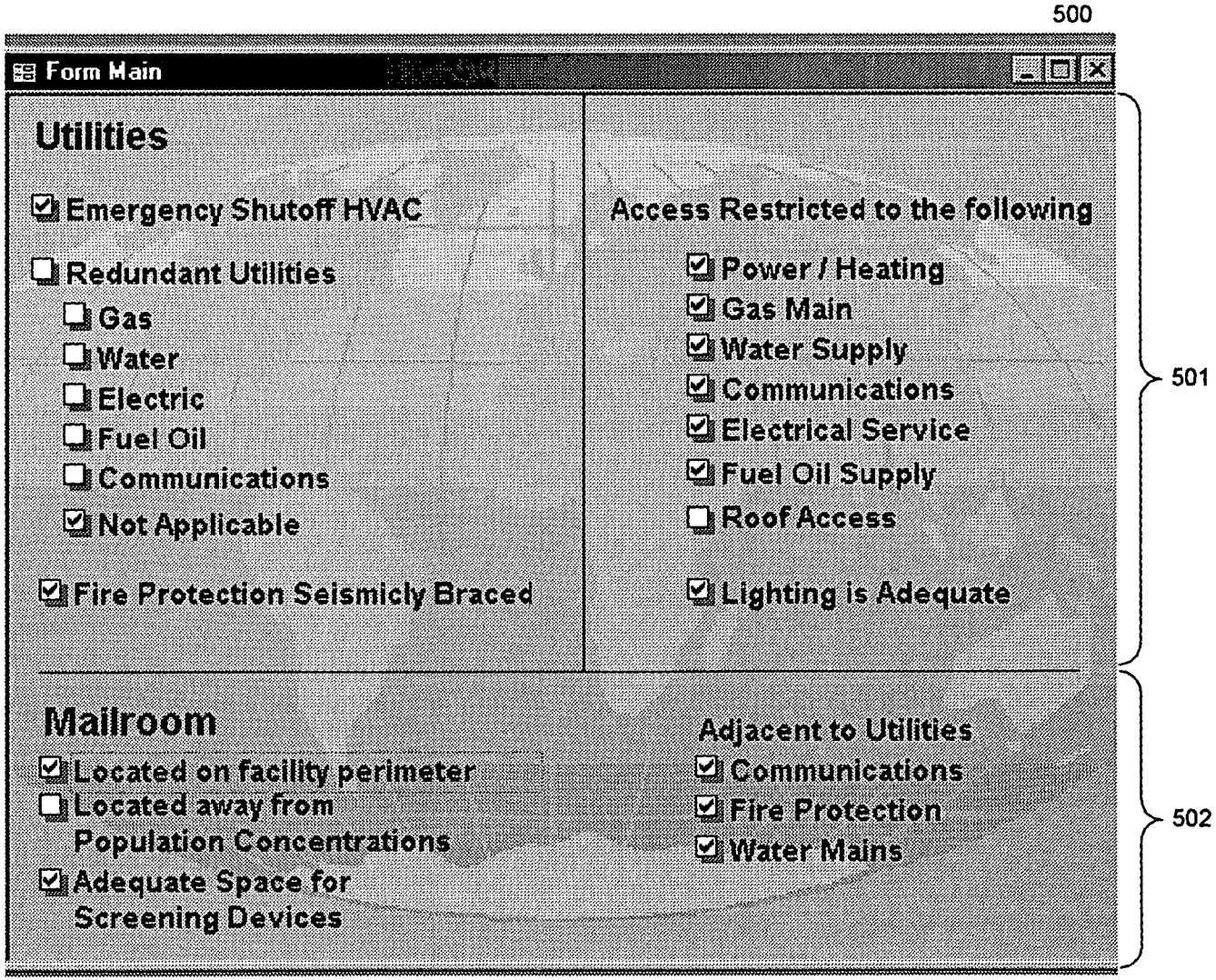
FIG. 5 is a display page for input of information describing utilities of a building in one embodiment.

FIG. 5 is a display page for input of information describing utilities of a building in one embodiment. The display page 500 includes various check fields 501 for indicating the status of utilities to the building. The display page also includes a mailroom area 502 for input of characteristics of the mailroom of the building.

Figure 6:
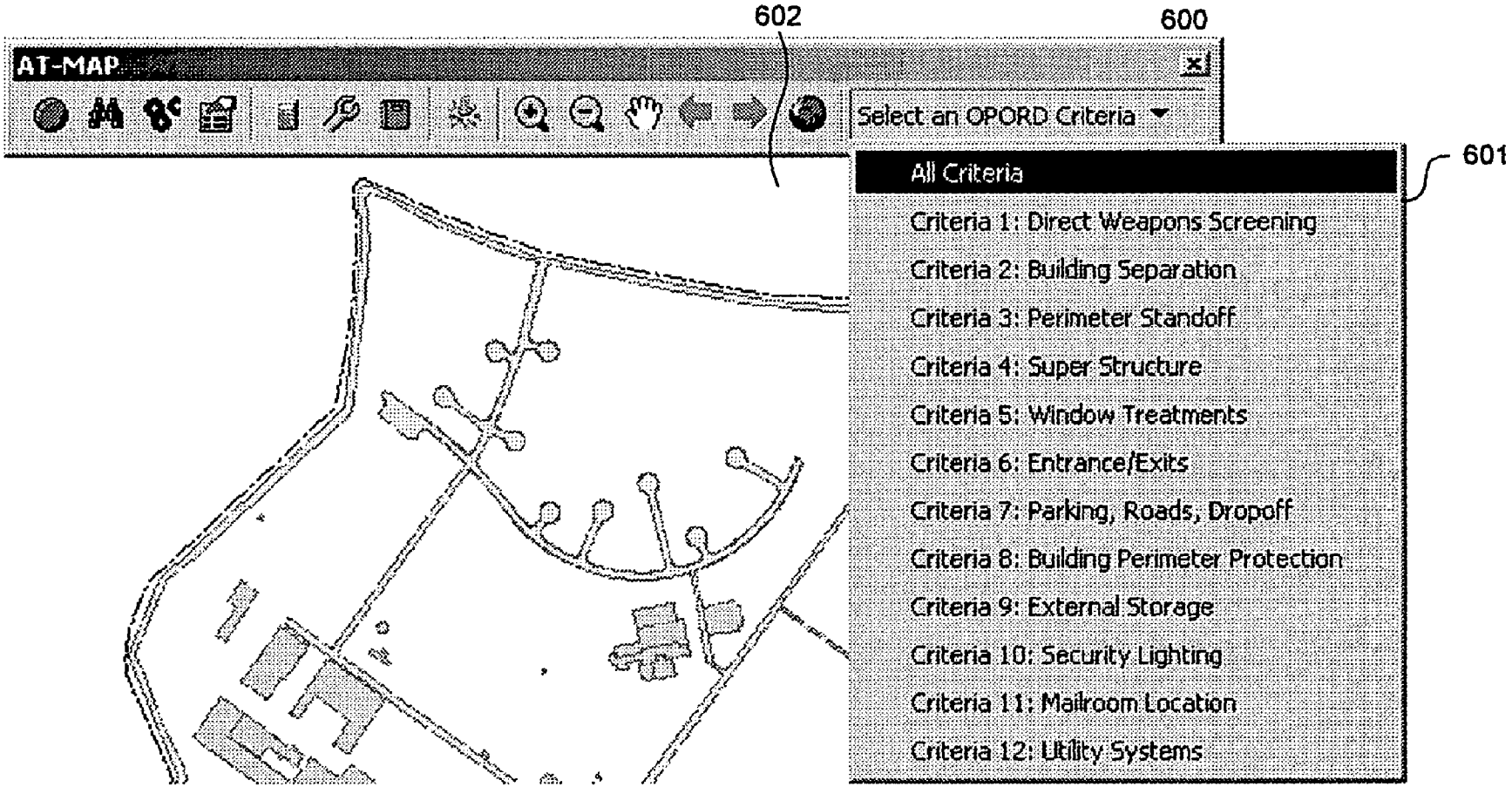
FIG. 6 is a display page illustrating the selection of a security requirement for display in one embodiment.

FIG. 6 is a display page illustrating the selection of a security requirement for display in one embodiment. The display page 600 includes a selection box 601 that lists each of the 12 security requirements or criteria in one embodiment. The security requirements are listed in Table 1 below. The security system allows the user to select one or more or all of the security requirements. The security system then highlights the buildings based on whether they comply with the selected security requirements. Map 602 illustrates a portion of a facility with buildings, roadways, and parking areas displayed.

Figure 7:
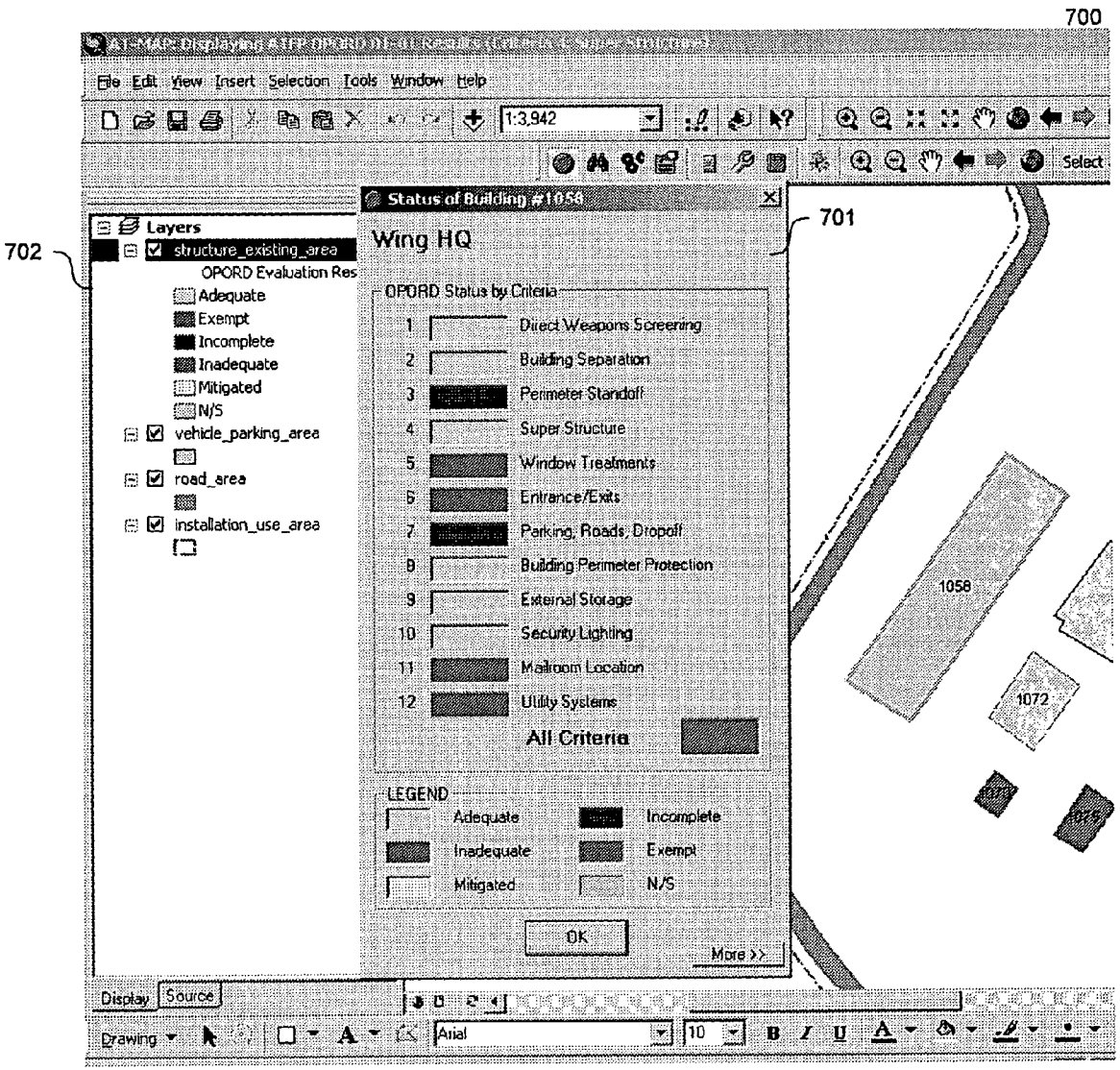
FIG. 7 is a display page illustrating detailed information about compliance of a building in one embodiment.

FIG. 7 is a display page illustrating detailed information about compliance of a building in one embodiment. In this example, the user has selected the building named "Wing HQ," and the security system has displayed the status of compliance for each of the security requirements for that building. The status is shown in window 701. The legend at the bottom of the window indicates the possible statuses of a security requirement. The statuses can be adequate, inadequate, mitigated, incomplete, exempt, and not surveyed. The statuses of adequate, inadequate, and mitigated have been described above. The status of incomplete indicates that not enough information has been collected to determine compliance (e.g., a building fails the security requirement, but a blast analysis has not been completed to determine the building's adequacy). The status of exempt indicates that for some reason the building does not need to comply with this security requirement (e.g., if the building is not currently being used, then a window treatments requirement may not apply). The status of not surveyed indicates that the information related to that security requirement has not been collected. Area 702 of the display page allows the user to select what information to be displayed on the map. In this example, the user has selected to display information related to the buildings, parking areas, roads, and use areas.

Figure 8:
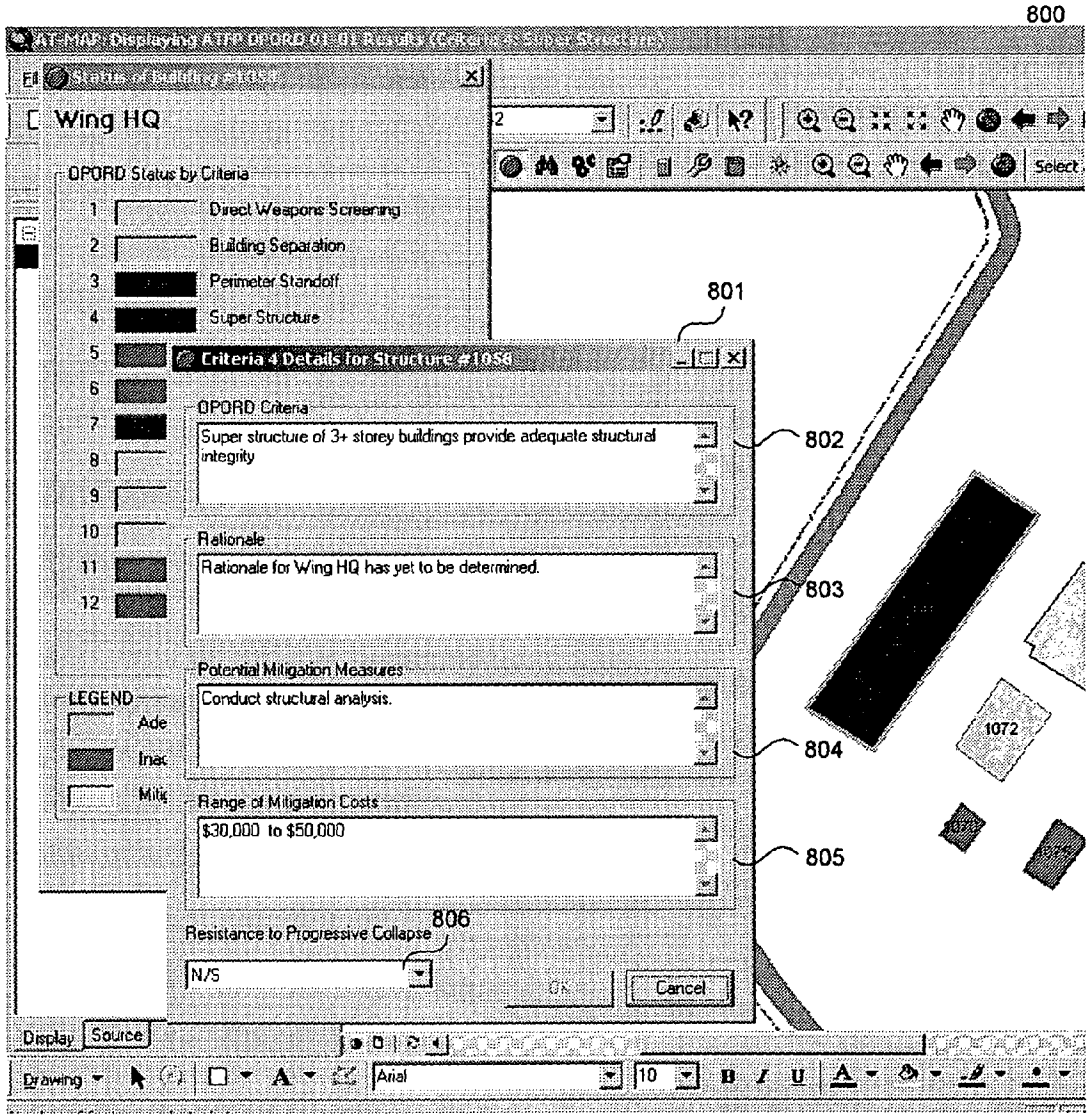
FIG. 8 is a display page illustrating mitigation information for a security requirement in one embodiment.

FIG. 8 is a display page illustrating mitigation information for a security requirement in one embodiment. In this example, the user has requested to provide mitigation information related to the super structure security requirement. Window 801 provides information describing the security requirement and mitigation measures. Area 802 describes the security requirement, area 803 describes a rationale for the security requirement, area 804 suggests possible mitigation measures that can be taken, and area 805 lists cost information. The information in areas 802 and 803 may be defined by the security system, and the information in areas 804 and 805 may be provided by security personnel. The window also contains field 806 for entry of resistance information for the structure. After the resistance information is updated, the security system may reevaluate the security requirements based on this additional information.

Figure 9:
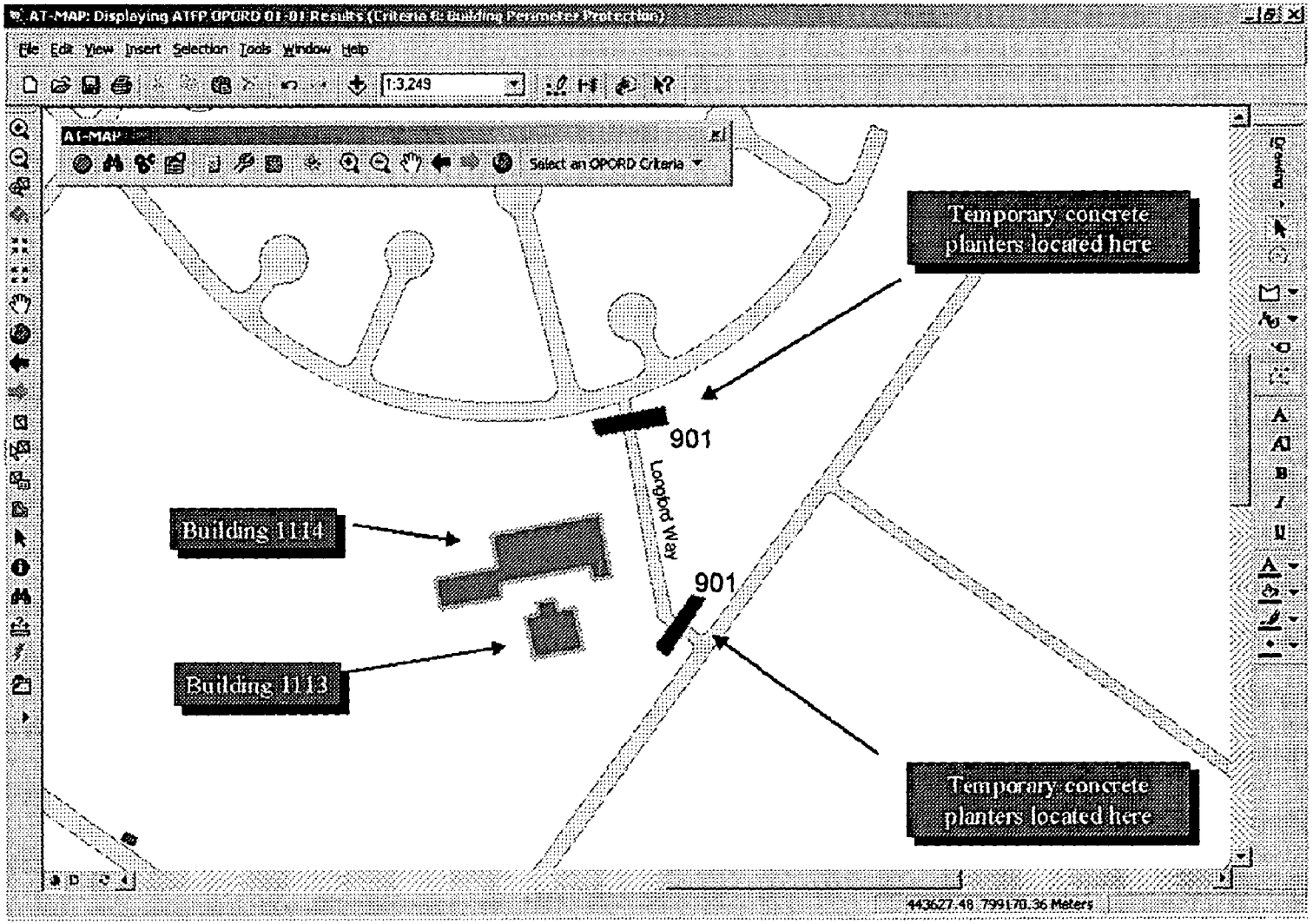
FIG. 9 is a display page illustrating a display of mitigation measures in one embodiment.

FIG. 9 is a display page illustrating a display of mitigation measures in one embodiment. In this example, the user has drawn objects 901 at the end of a road to indicate that the road has been temporarily blocked off. This information may be stored in the map database.

Figure 10:
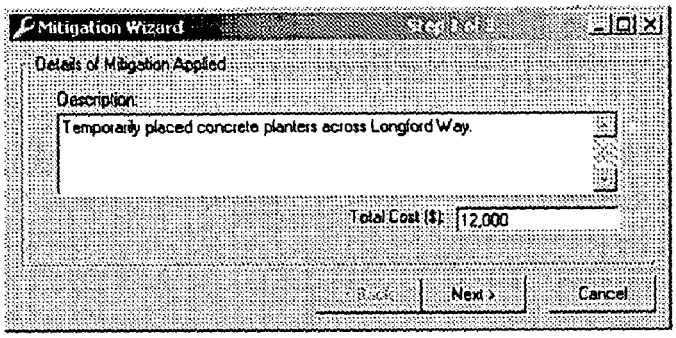
FIG. 10 illustrates dialog boxes for collecting mitigation information in one embodiment.
Figure 10:
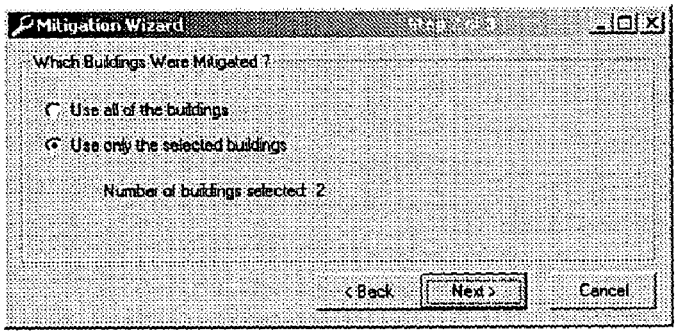
Figure 10:
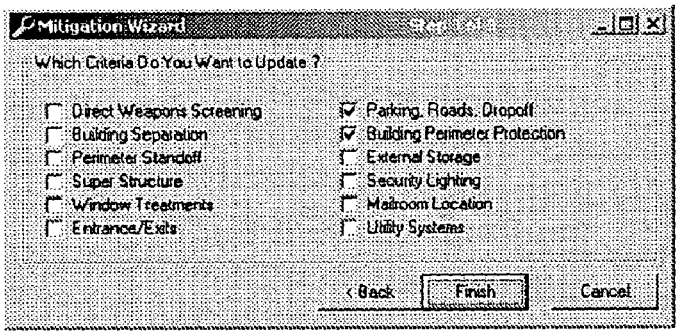

FIG. 10 illustrates dialog boxes for collecting mitigation information in one embodiment. In dialog box 1001, the user enters a description of the mitigation and its cost. In dialog box 1002, the user identifies the buildings that have been mitigated. In dialog box 1003, the user indicates which security requirements should have their compliance reevaluated in light of the mitigation.

As these display pages indicate, the security system can be used to evaluate whether the buildings of a military base comply with security requirements. One skilled in the art will appreciate that the security system can be used to analyze the security in many other environments. Although different data would be collected and different security requirements would be specified, one skilled in the art will know how to adapt the described embodiment to those environments.

Table 1 lists the security requirements for the buildings of a military base in one embodiment.

TABLE 1

| | Security Requirement | Description |
|---|---|---|
| 1 | Direct Weapons Screening | ensure that no weapons can be aimed directly at an entrance to the building from the perimeter |
| 2 | Building Separation | ensure that the buildings are not too close together |
| 3 | Perimeter Standoff | ensure that the building is not too close to the perimeter |
| 4. | Super Structure | ensure that the building is strong enough to withstand a blast |
| 5 | Window Treatments | ensure that the windows will not shatter with a blast |
| 6. | Entrance/Exits | ensure that doors are strong |
| 7. | Parking, Roads, Drop-off | ensure adequate protection between each building and roads, parking and drop-off areas |
| 8. | Building Perimeter Protection | ensure that the perimeter of the building can be secured |
| 9 | External Storage | ensure that external storage areas are not too close to the building |

TABLE 1-continued

| | Security Requirement | Description |
|---|---|---|
| 10 | Security Lighting | ensure adequate outside lighting |
| 11 | Mailroom Location | ensure that damage to mailroom in building can be isolated |
| 12 | Utility Systems | ensure that utilities to building can be protected |

The security system takes the information provided about the characteristics of a building and calculates various values from the provided information. For example, the calculated values may include the distance to the closest building and whether the window treatments are adequate. Table 2 illustrates some sample calculations that are used in determining compliance with the 12 security requirements.

TABLE 2

| | Calculated Values | Calculation Rules |
|---|---|---|
| 1 | Screened | "adequate" if no walls visible<br>"adequate" if windows are covered with shutters or curtains |
| 2 | Building Type | "primary gathering" if troop billeting<br>"exempt" if uninhabited<br>"inhabited" if stand-alone retail |
| | Closest Building | distance to closest building |
| 3 | Distance to Perimeter | distance to facility perimeter |
| 4 | Number of Stories | number of stories in the building |
| 5 | Window Frame | "adequate" if blast resistant |
| | Window Thickness | "adequate" if single pane and single pane polycarbonate<br>"adequate" if double pane and double pane polycarbonate<br>"adequate" if single pane, single pane laminate, thickness > 7.5<br>"adequate" if double pane, double pane laminate, thickness > 7.5 |
| | Calculated Values | Calculation Rules |
| 6 | Door Type | "adequate" if opens out, blast door, and not glazed window<br>"adequate" if opens out, blast door, and glazed window thick enough |
| | Entrance Exit | "adequate" if walls are adequate |
| 7 | Closest Drop-off | distance to closest |
| | Drop-off Qualities | "adequate" if no wall adjacent to the drive up |
| 8 | Perimeter Barriers SVB | "mitigated" if walls within second perimeter<br>"mitigated" if wall barrier is jersey or fence |
| 9 | Closest Storage | distance to closest external storage |
| 10 | Exterior Light | "adequate" if lighting is sufficient |
| 11 | Mailroom | "adequate" if on the facility perimeter, not near communications facilities, and not near a population center |
| 12 | System Location | "adequate" if a wall has no air intake or one above a minimum height<br>"adequate" if utilities have emergency shutoff, redundancies, and restricted access |

After the values are calculated, the security system then determines whether the building complies with each security requirement. Table 3 illustrates the rules for compliance for each security requirement and the corresponding highlighting. Green corresponds to adequate, yellow corresponds to mitigated, red corresponds to inadequate, and gray corresponds to incomplete or not surveyed.

TABLE 3

| | System Requirement | Green | Yellow | Red | Gray |
|---|---|---|---|---|---|
| 1 | Direct Weapons Screening | Screened is adequate | Screened is mitigated | Screened is inadequate | Screened is null |
| 2 | Building Separation | Closest Building > threshold | Blast Resistant 2 | Closest Building < threshold | Closest Building is null |
| 3 | Perimeter Standoff | Distance to Perimeter > threshold | Blast Resistant 3 and Distance to Perimeter > blast resistant threshold | Distance to Perimeter < blast resistance threshold | Distance to Perimeter is null |
| 4. | Super Structure | Number of Stories >= 3 and Super Structure is adequate | Number of Stories >= 3 and Super Structure is mitigated | Number of Stories >= 3 and Super Structure is inadequate | Super Structure is null or Number of Stories < 3 |
| 5 | Window Treatments | Window Thickness is adequate | Window Thickness is mitigated | Window Thickness is inadequate | Window Thickness is null |
| 6. | Entrance/ Exit System Requirement | Entrance/Exit is adequate Green | Entrance/Exit is mitigated Yellow | Entrance/Exit is inadequate Red | Entrance/Exit is null Gray |
| 7. | Parking, Roads, Drop-off | Closest Drop-off >= threshold | mitigated | Closest Drop-off < threshold | |
| 8. | Building Perimeter Protection | Perimeter Barriers SVB is adequate | Perimeter Barriers SVB is mitigated | Perimeter Barriers SVB is inadequate | Perimeter Barriers SVB is null |
| 9 | External Storage | Closest Storage >= threshold | mitigated | Closest Storage < threshold | Closest Storage is null |
| 10 | Security Lighting | Entrance/Exit is adequate | Entrance/Exit is mitigated | Entrance/Exit is inadequate | Entrance/Exit is null |
| 11 | Mailroom Location | Mailroom is adequate | Mailroom is mitigated | Mailroom is inadequate | Mailroom is null |
| 12 | Utility Systems | System Location is adequate | System Location is mitigated | System Location is inadequate | System Location is null |

Figure 11:
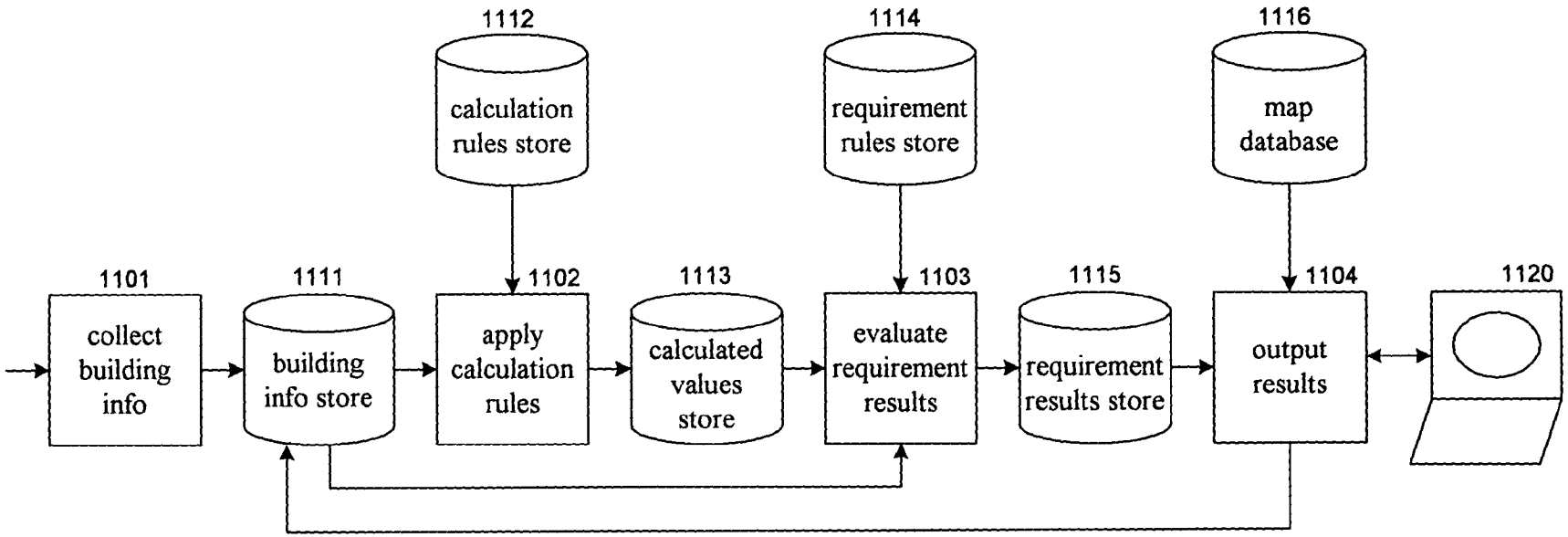
FIG. 11 is a block diagram illustrating components of the security system in one embodiment.

FIG. 11 is a block diagram illustrating components of the security system in one embodiment. The security system includes a collect building information component 1101, an apply calculation rules component 1102, an evaluate security requirements component 1103, and an output results component 1104, which are all processing components. The security system also includes a building information store 1111, a calculation rules store 1112, a calculated value store 1113, a requirements rule store 1114, a requirement results store 1115, and a map database 1116, which are all storage components. The collect building information component displays the display pages of FIGS. 1–5 and stores the collected information in the building information store. The apply calculation rules component applies the calculation rules to the provided information of the building information store. The apply calculation rules component stores its calculated values in the calculated value store. The evaluate security requirements component applies the requirement rules to the calculated values and the provided information to generate the requirement results. The output results component uses the map database information and the requirement results to generate the output for the user. The output results component may also input certain information and store it in the building information store. The output results component may also request the apply calculation rules component and the evaluate requirements component to reprocess their information.

The security system may be implemented on computer systems that may include a central processing unit, memory, input devices (e.g., keyboard and pointing devices), output devices (e.g., display devices), and storage devices (e.g., disk drives). The memory and storage devices are computer-readable media that may contain instructions that implement the security system. In addition, the data structures and message structures may be stored or transmitted via a data transmission medium, such as a signal on a communications link. Various communications links may be used, such as the Internet, a local area network, a wide area network, or a point-to-point dial-up connection.

Figure 12:
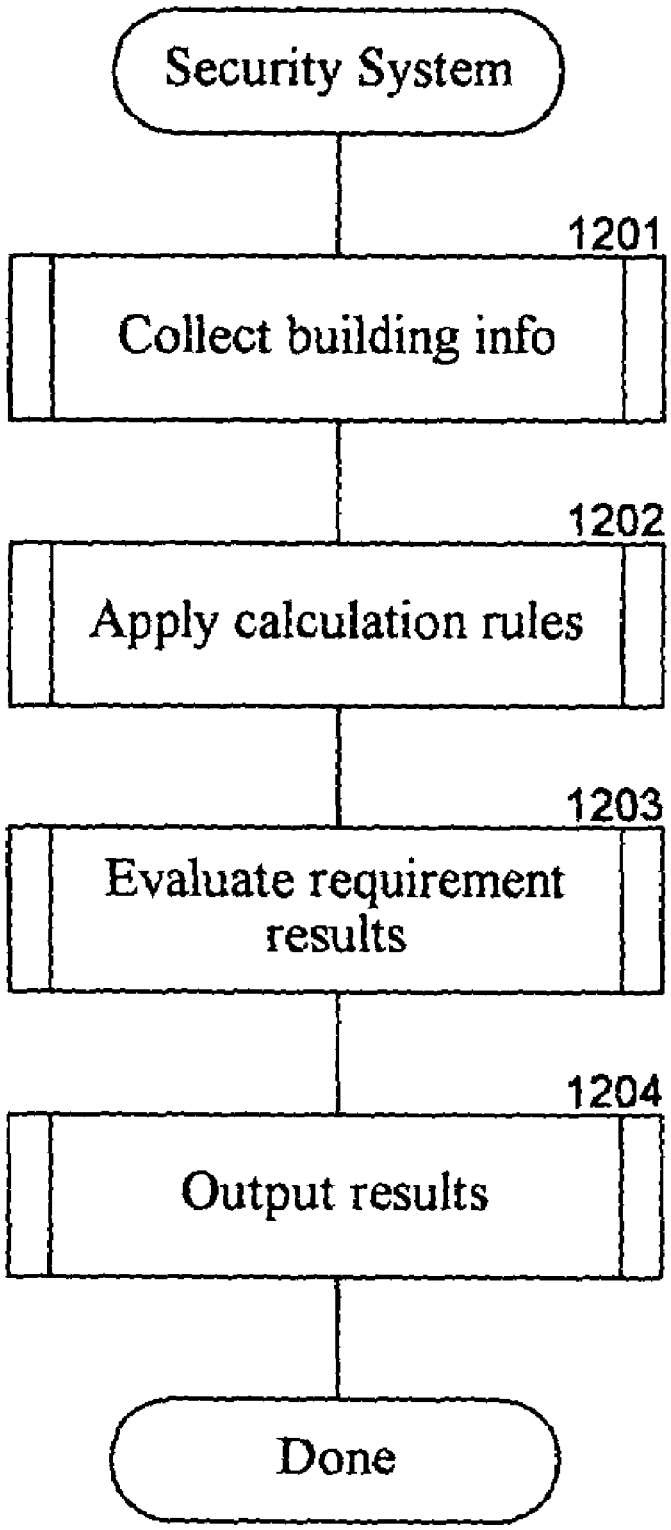
FIG. 12 is a flow diagram illustrating the overall processing of the security system in one embodiment.

FIG. 12 is a flow diagram illustrating the overall processing of the security system in one embodiment. In block 1201, the system collects building information and stores it in the building information store. In block 1202, the system applies the calculation rules to the building information to generate the calculated values. In block 1203, the component evaluates the security requirements to generate the compliance results. In block 1204, the component outputs the results.

Figure 13:
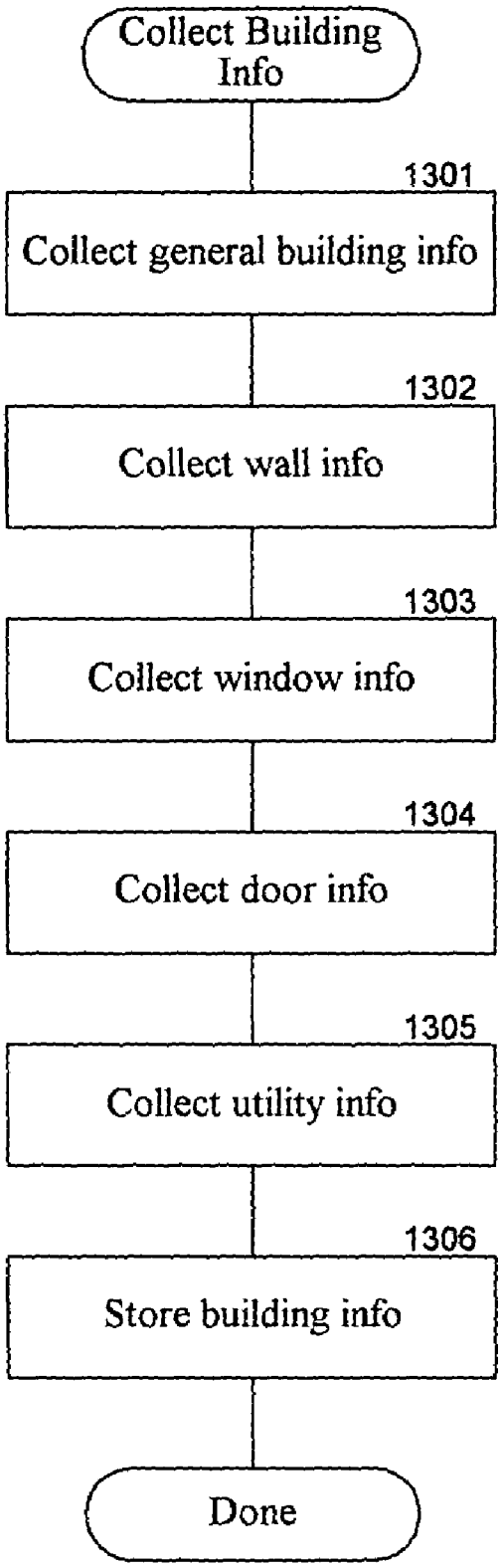
FIG. 13 is a flow diagram of the collect building information component in one embodiment.

FIG. 13 is a flow diagram of the collect building information component in one embodiment. In block 1301, the component collects the general building information using the display page of FIG. 1. In block 1302, the component collects the information on the walls using the display page of FIG. 2. In block 1303, the component collects window information using the display page of FIG. 3. In block 1304, the system collects door information using the display page of FIG. 4. In block 1305, the system collects utility information using the display page of FIG. 5. In block 1306, the component stores the building information in the building information store and completes.

Figure 14:
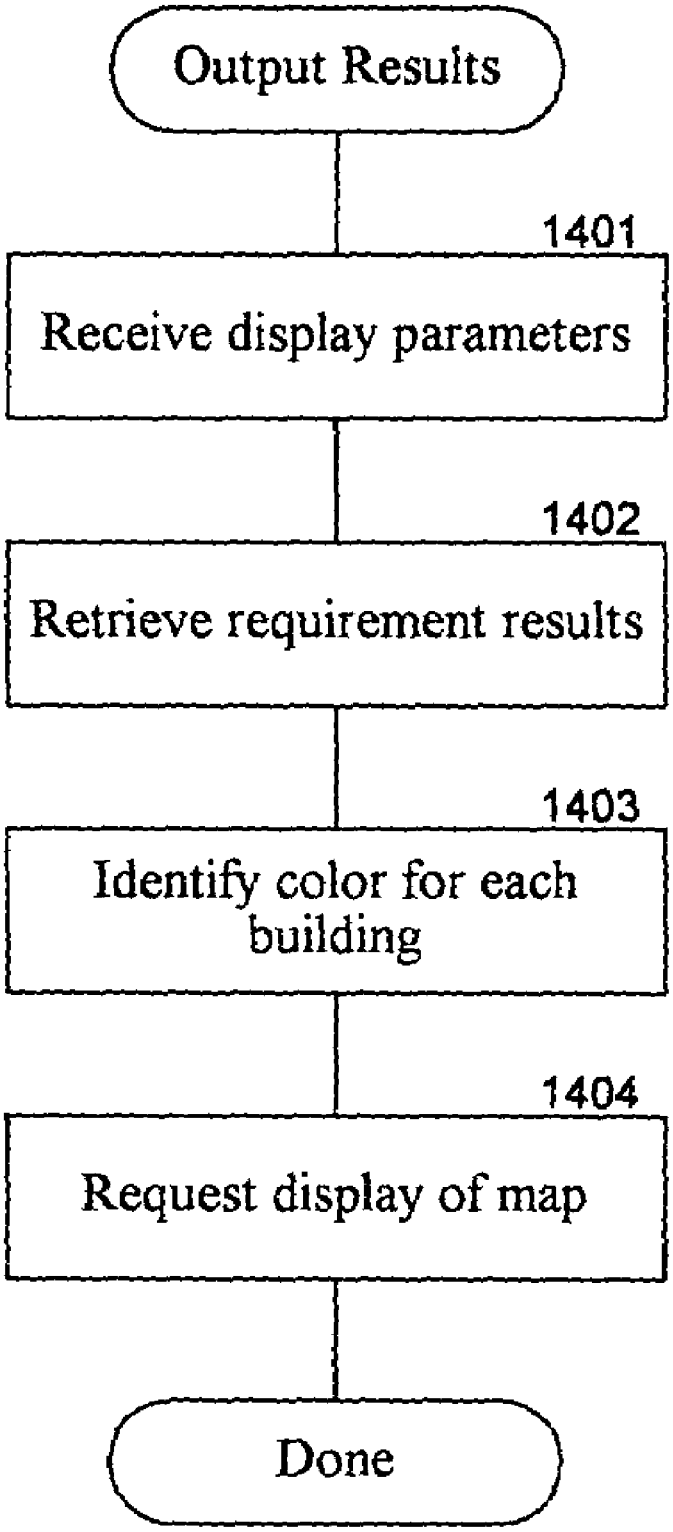
FIG. 14 is a flow diagram of the output results component in one embodiment.

FIG. 14 is a flow diagram of the output results component in one embodiment. In block 1401, the component receives display parameters, such as an indication to display buildings and roadways and an indication to display highlighting for certain security requirements. In block 1402, the component retrieves the results. In block 1403, the component identifies the color for each building. In block 1404, the component requests the display of the map with the indicated coloring. The component then completes.

One skilled in the art will appreciate that although specific embodiments of the security system have been described herein for purposes of illustration, various modifications may be made without deviating from the spirit and scope of the invention. For example, one skilled in the art will appreciate that the information used to evaluate compliance with a security requirement can be derived from the map information (e.g., distance to perimeter). The security requirements can also relate to any type of security risk, such as a biological hazard, chemical hazard, or aerial hazard (e.g., a missile). One skilled in the art will appreciate that the principles of the security system can be applied to non-security environments. For example, a system may be developed to analyze safety requirements, rather than security requirement. A city may promulgate various safety requirements such as maximum distance of a building to fire hydrant, minimum earthquake standards, minimum number of exits for a building, minimum distance between a structure and a chemical tank, and so on. The city's fire department may use the safety system to track, analyze, and view the compliance to the safety requirements. Similarly, a corporation may use the safety system to track compliance of the buildings of its campus. A system may also be developed to analyze other types of requirements such as environmental, building code, and health requirements. In addition, the elements of a facility can include permanent and temporary structures, tanks, sewers, power lines, waste storage area, docks, air fields, vehicles, and so on. The elements can also include sub-elements of an element to form a hierarchy of elements. For example, each door of a building can be a sub-element that can be separately highlighted to indicate its compliance with the requirements. The system may allow a user to select the type and level of sub-element to be displayed. The facilities can include shipping terminals, ship ports, airports, a building, a city, a university, fuel depots, manufacturing facilities, shopping malls, parking structures, and so on. In general, a system can be provided that allows for the tracking, analysis, and viewing of compliance of a facility having elements with requirements. Accordingly, the invention is not limited except by the appended claims.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. A method in a computer system for evaluating security of a facility having buildings, the method comprising:

for each building of the facility, providing information describing characteristics of the building;

providing calculation rules that indicate how to calculate values for a building based on the characteristics of a building;

providing compliance rules for security requirements for determining, based on the calculated values, whether a building complies with the security requirements;

for each building of the facility, applying the calculation rules to calculate values, based on the characteristics of the building; and applying the compliance rules to determine, based on the calculated values, whether the building complies with the security requirements; and displaying to a user a map of the facility along with an indication of whether a building complies with the security requirements.

2. The method of claim 1 wherein each building that complies the security requirements is highlighted when displayed.

3. The method of claim 2 wherein the highlighting is the displaying of the building in green.

4. The method of claim 1 wherein the building complies the security requirements when it meets each security requirement.

5. The method of claim 1 wherein the applying of the compliance rules indicates whether each security requirement for a building is adequate or inadequate.

6. The method of claim 5 wherein the applying of the provided rules also indicates whether a security requirement for the building that is inadequate has been mitigated.

7. The method of claim 1 including receiving from a user a selection of a building and displaying to the user provided information for the selected building.

8. The method of claim 1 including receiving from a user a selection of a building and displaying to the user an indication as to whether the building complies with each security requirement.

9. The method of claim 1 including receiving from the user additional information on a building and reapplying the provided rules to determine, based on the provided information, and the additional information whether the building complies with the security requirements.

10. The method of claim 1 including receiving from the user an indication of whether a security requirement of building that is inadequate has been mitigated.

11. The method of claim 1 wherein characteristics of a building relate to windows, doors, and walls of the building.

12. The method of claim 1 wherein the characteristics of a building relate to use of the building.

13. The method of claim 1 wherein provided information is derived from map information of the facility.

14. The method of claim 1 wherein the facility is a military installation.

15. The method of claim 1 wherein the facility is a campus of a nonmilitary organization.

16. The method of claim 15 wherein the nonmilitary organization is a company.

17. The method of claim 1 wherein the displayed map includes road information.

18. The method of claim 1 wherein the displayed map includes parking information.

19. The method of claim 1 wherein the displayed map includes facility perimeter information.

20. The method of claim 1 wherein the displayed map includes mitigation information.

21. The method of claim 1 including allowing a user to relax a security requirement to assist in evaluating the benefit of complying with the nonrelaxed security requirement.

* * * * *